US009947447B2

(12) United States Patent
Mao et al.

(10) Patent No.: US 9,947,447 B2
(45) Date of Patent: Apr. 17, 2018

(54) NEODYMIUM IRON BORON MAGNET AND PREPARATION METHOD THEREOF

(71) Applicant: JL MAG RARE-EARTH CO., LTD., Ganzhou, Jiangxi (CN)

(72) Inventors: Huayun Mao, Ganzhou (CN); Baogui Cai, Ganzhou (CN); Lujun Liu, Ganzhou (CN); Jinhong Zhang, Ganzhou (CN)

(73) Assignee: JL MAG RARE-EARTH CO., LTD., Ganzhou (CN)

( * ) Notice: Subject to any disclaimer, the term of this patent is extended or adjusted under 35 U.S.C. 154(b) by 0 days.

(21) Appl. No.: 15/268,725

(22) Filed: Sep. 19, 2016

(65) Prior Publication Data

US 2017/0178778 A1 Jun. 22, 2017

(30) Foreign Application Priority Data

Dec. 18, 2015 (CN) ..... 2015 1 0975767
May 10, 2016 (CN) ..... 2016 1 0305312

(51) Int. Cl.
*H01H 1/44* (2006.01)
*H01F 1/44* (2006.01)
(Continued)

(52) U.S. Cl.
CPC ..... *H01F 1/442* (2013.01); *H01F 1/42* (2013.01); *H01F 7/02* (2013.01); *H01F 41/0293* (2013.01)

(58) Field of Classification Search
CPC ... H01F 1/442; H01F 1/42; H01F 7/02; H01F 41/0293
(Continued)

(56) References Cited

U.S. PATENT DOCUMENTS

2006/0022175 A1* 2/2006 Komuro ..... H01F 1/0572 252/500
2007/0240789 A1 10/2007 Nakamura et al.
(Continued)

FOREIGN PATENT DOCUMENTS

CN 101158024 A 4/2008
CN 102347126 A 2/2012
(Continued)

OTHER PUBLICATIONS

State Intellectual Property Office, Chinese Office Action for Application No. 201510975767.0, dated Feb. 24, 2017.
(Continued)

*Primary Examiner* — Bernard Rojas
(74) *Attorney, Agent, or Firm* — Honigman Miller Schwartz and Cohn LLP; Matthew H. Szalach; Jonathan P. O'Brien

(57) ABSTRACT

The present invention, on the one hand, provides a neodymium iron boron magnet, comprising neodymium iron boron magnet blank and the RTMH alloy layer compounded on the surface; the R is one or more selected from rare earth elements; the T is Fe and/or Co; the M is one or more selected from the group consisting of Al, Si, Ti, V, Cr, Mn, Ni, Cu, Zn, Ga, Ge, Zr, Nb, Mo, Ag, In, Sn, Sb, Hf, Ta, W, Pt, Au, Pb and Bi; the H is hydrogen element. By the present invention, the coercive force of magnets is significantly enhanced, and at the same time, the original magnetic remanence and maximum magnetic energy product of the magnets are not significantly reduced.

7 Claims, 2 Drawing Sheets

(51) Int. Cl.
*H01F 1/42* (2006.01)
*H01F 7/02* (2006.01)
*H01F 41/02* (2006.01)

(58) Field of Classification Search
USPC ..... 335/302–306
See application file for complete search history.

(56) References Cited

U.S. PATENT DOCUMENTS

| | | | | |
|---|---|---|---|---|
| 2009/0322459 | A1 | 12/2009 | Nagata et al. | |
| 2013/0093551 | A1* | 4/2013 | Peng | C22C 38/005 335/302 |
| 2013/0093552 | A1* | 4/2013 | Wang | C22C 28/00 335/302 |
| 2013/0169394 | A1 | 7/2013 | Sagawa et al. | |
| 2014/0308440 | A1 | 10/2014 | Sagawa | |
| 2014/0329007 | A1 | 11/2014 | Obata | |
| 2014/0352847 | A1 | 12/2014 | Yu et al. | |
| 2015/0069677 | A1 | 3/2015 | Zakotnik et al. | |
| 2015/0187494 | A1 | 7/2015 | Lee et al. | |

FOREIGN PATENT DOCUMENTS

| | | | |
|---|---|---|---|
| CN | 103258633 | A | 8/2013 |
| CN | 103903825 | A | 7/2014 |
| CN | 104112580 | A | 10/2014 |
| CN | 104900359 | A | 9/2015 |
| JP | 2007287875 | A | 11/2007 |
| JP | 2009170541 | A | 7/2009 |
| JP | 2012169436 | A | 9/2012 |
| JP | 2013042152 | A | 2/2013 |
| WO | 2008032667 | A1 | 3/2008 |

OTHER PUBLICATIONS

State Intellectual Property Office, Chinese Office Action for Application No. 201610305312.2, dated Apr. 26, 2017.
European Patent Office, Extended European search report for EP Application No. 16185333.8, dated May 12, 2017.
Japan Patent Office, Notification of Reasons for Refusal for JP Application No. 2016-190585, dated Dec. 5, 2017.

* cited by examiner

NEODYMIUM IRON BORON MAGNET AND PREPARATION METHOD THEREOF

The present invention claims priority to Chinese Patent Application No. 201510975767.0 filed with the Chinese Patent Office on Dec. 18, 2015, and titled "Mixture of Light and Heavy Rare Earths for Neodymium Iron Boron Magnet, Neodymium Iron Boron Magnet and Preparation Method Thereof" as well as Chinese Patent Application No. 201610305312.2 filed with the Chinese Patent Office on May 10, 2016, and titled "Neodymium Iron Boron Magnet and Preparation Methods Thereof," the disclosures of which are incorporated herein by reference in their entirety.

FIELD OF THE INVENTION

The present invention refers to the field of technologies for magnet preparation, in particular to neodymium iron boron magnet and preparation methods thereof.

BACKGROUND OF THE INVENTION

Magnets are materials capable of generating a magnetic field, which have the property of attracting ferromagnetic substances such as metals like iron, nickel, cobalt or the like. Magnets are generally classified into permanent magnets and soft magnets. Most of the materials as magnetizer and electromagnets are soft magnets, the polarity thereof varies as the polarity of the magnetic field applied thereon changes; and permanent magnets, i.e. hard magnets, are magnets capable of keeping their magnetic properties for a long time, which are not easily demagnetized, and are not easily magnetized, either. Therefore, no matter in industrial production or in daily life, a hard magnet is one of the most commonly-used powerful materials.

Hard magnets can be classified into natural magnets and artificial magnets. Artificial magnets are the magnets that are produced by synthesizing the alloys of different materials to not only be capable of obtaining the effects identical to those of natural magnets (lodestone) but also be capable of increasing the magnetic force. Artificial magnets have occurred since the eighteenth century, but the process to produce materials having stronger magnetic properties is very slow. Late in 1930s, aluminum nickel cobalt magnets (AlNiCo) were produced, making the large-scale use of magnets possible. Afterwards, ferrite was produced in 1950s. In 1960s, the occurrence of rare earth permanent magnets has developed a new era for the application of magnets. The first generation is samarium cobalt permanent magnet $SmCo_5$, and the second generation is precipitation hardening type of samarium cobalt permanent magnets $Sm_2Co_{17}$. Up to now, the third generation neodymium iron boron permanent magnets materials (NdFeB) have been developed. Although ferrite magnets remain the most commonly-used permanent magnets materials at present, the output value of neodymium iron boron magnets has greatly exceeded that of the ferrite permanent magnets materials. Neodymium iron boron magnets have been developed into a big industry.

Neodymium iron boron magnet is also referred to as neodymium magnet, has a chemical formula of $Nd_2Fe_{14}B$, is a type of artificial permanent magnet and is the permanent magnet having the strongest magnetic force till now. Their maximum magnetic energy product ($BH_{max}$) is at least 10 times higher than that of ferrite. When it is in a state of bare magnet, the magnetic force thereof can reach about 3500 gauss. Neodymium iron boron magnets have the advantages such as high cost performance, small volume, light weight, good mechanical properties and strong magnetic properties. Such advantage of high-energy density makes neodymium iron boron permanent magnets materials extensively applicable in modern industry and electronic technology, and they are called as king of magnets in magnetology. Therefore, how to expand applications of neodymium iron boron magnets has always been the focus that draws the continuing attention of the industry.

After several decades of development, the magnetic properties of sintered neodymium iron boron magnets have been constantly enhanced, wherein magnetic remanence Br and maximum magnetic energy product $(BH)_{max}$ have been close to the limit value. However, the actual coercive force of sintered NdFeB is only about 30% of the theoretical value. Therefore, increasing coercive force is critical for the enhancement of the comprehensive properties of sintered neodymium iron boron magnets. Currently, methods for enhancing coercive force are mainly achieved by means of enhancing coercive force by direct addition of heavy rare earth during smelting. However, these methods will evidently reduce magnetic remanence and magnetic energy product on the basis of enhancing the coercive force.

Therefore, how to find a more suitable method for enhancing coercive force, while maintaining magnetic remanence and maximum magnetic energy product at the same time, has always been the focus that draws the extensive attention of the research-and-development type manufacturers of neodymium iron boron magnets in the industry.

SUMMARY OF THE INVENTION

In view of this, a technical problem to be solved by the present invention is to provide a neodymium iron boron magnet and a preparation method thereof. The preparation method provided according to the present invention has a simple process, can effectively enhance the coercive force of the neodymium iron boron magnet, and can also maintain the magnetic remanence and maximum magnetic energy product of the magnet.

Another technical problem to be solved by the present invention is to provide a mixture of light and heavy rare earths for neodymium iron boron magnet, a neodymium iron boron magnet prepared by using the mixture of light and heavy rare earths and a method for preparing the neodymium iron boron magnet. The method for preparing the neodymium iron boron magnet provided according to the present invention has a simple process, can effectively enhance the coercive force of the neodymium iron boron magnet, and can also maintain the magnetic remanence and maximum magnetic energy product of the magnet.

In a first embodiment, the present invention provides a neodymium iron boron magnet comprising a neodymium iron boron magnet blank and an RTMH alloy layer compounded on the surface of the blank, wherein:

the R is one or more selected from rare earth elements;

the T is Fe and/or Co;

the M is one or more selected from the group consisting of Al, Si, Ti, V, Cr, Mn, Ni, Cu, Zn, Ga, Ge, Zr, Nb, Mo, Ag, In, Sn, Sb, Hf, Ta, W, Pt, Au, Pb and Bi; and the H is hydrogen element.

Preferably, the RTMH alloy layer includes:

50 to 100 parts by weight of R;

44 parts by weight or less of T;

49 parts by weight or less of M;

2 parts by weight or less of H.

Preferably, the mass of the RTMH alloy layer is less than or equal to 5% with respect to the total mass of the neodymium iron boron magnet.

Preferably, the neodymium iron boron magnet blank comprises respective ingredients in the following mass percentages: Pr—Nd: 28% to 33%; Dy: 0 to 10%; Tb: 0 to 10%; Nb: 0 to 5%; B: 0.5% to 2.0%; Al: 0 to 3.0%; Cu: 0 to 1%; Co: 0 to 3%; Ga: 0 to 2%; Gd: 0 to 2%; Ho: 0 to 2%; Zr: 0 to 2%; with Fe being the balance.

Preferably, the ingredients of the neodymium iron boron magnet blank also comprise one or more of other rare earth elements.

The present invention provides a method for preparing the neodymium iron boron magnet according to the first embodiment as described above, comprising the following steps:

A) mixing RTMH alloy powder with an organic solvent to obtain a turbid liquid;

the R is one or more selected from rare earth elements; the T is Fe and/or Co; the M is one or more selected from the group consisting of Al, Si, Ti, V, Cr, Mn, Ni, Cu, Zn, Ga, Ge, Zr, Nb, Mo, Ag, In, Sn, Sb, Hf, Ta, W, Pt, Au, Pb and Bi; and the H is hydrogen element;

B) coating the turbid liquid obtained from the above step onto the surface of a neodymium iron boron magnet blank to obtain a semi-finished product; and C) subjecting the semi-finished product obtained from the above step to heat treatment to obtain the neodymium iron boron magnet.

Preferably, the average particle size of the RTMH alloy powder is 1 to 20 μm; and the organic solvent comprises one or more selected from the group consisting of gasoline, ethanol and acrylic acid.

Preferably, the mixing is conducted at a temperature of 15 to 35° C. for a period of 7 to 17 h.

Preferably, the heat treatment comprises high-temperature diffusion treatment and low-temperature tempering treatment.

Preferably, the high-temperature diffusion treatment is carried out at a temperature of 700 to 1000° C. for a period of 3 to 20 h; and the low-temperature tempering treatment is carried out at a temperature of 350 to 750° C. for a period of 1 to 8 h.

The neodymium iron boron magnet provided according to the first embodiment of the present invention comprise the neodymium iron boron magnet blank and the RTMH alloy layer compounded on the surface thereof; the R is one or more selected from rare earth elements; the T is Fe and/or Co; the M is one or more selected from the group consisting of Al, Si, Ti, V, Cr, Mn, Ni, Cu, Zn, Ga, Ge, Zr, Nb, Mo, Ag, In, Sn, Sb, Hf, Ta, W, Pt, Au, Pb and Bi; the H is hydrogen element. Compared with the prior art, the present invention employs coating RTMH alloy layer onto the surface of neodymium iron boron magnet blank, which not only forms an alloy film layer on the surface of magnets, but also can generate the crystal boundary diffusion and permeation at the boundaries, such that the coercive force of the magnet is significantly enhanced, and at the same time, the original magnetic remanence and maximum magnetic energy product of the magnet are not significantly reduced. The present invention avoids the problem present in the prior art method that after oxidation with heavy rare earth compounds, not only the effect of enhancing coercive force is not attained, but also the resources of heavy rare earth are wasted. The present invention saves the resources of heavy rare earth, and reduces the cost. The experimental results indicate that, as for the neodymium iron boron magnet provided by the first embodiment of the present invention, i.e. a composite type of neodymium iron boron magnet, the coercive force thereof can be enhanced by a maximum of about 51%, while the magnetic remanence and maximum magnetic energy product essentially remain constant and are not significantly reduced.

In a second embodiment, the present invention provides a neodymium iron boron magnet, which is obtained after subjecting neodymium iron boron magnet blank and a mixture of light and heavy rare earths to diffusing heat treatment.

The mixture of light and heavy rare earths used for the neodymium iron boron magnet provided according to the present invention comprises:

2 to 20 parts by weight of light rare earth;

78 to 98 parts by weight of heavy rare earth; and 0 to 2 parts by weight of M;

wherein the M is one or more selected from the group consisting of Al, Cu, Co, Ni, Zr and Nb.

Preferably, the light rare earth is one or more selected from the group consisting of La, Ce, Pr and Nd;

the heavy rare earth is one or more selected from the group consisting of Dy and Tb.

Preferably, the neodymium iron boron magnet blank comprises respective ingredients in the following mass percentages: Pr—Nd: 28% to 33%; Dy: 0 to 10%; Tb: 0 to 10%; Nb: 0 to 5%; B: 0.5% to 2.0%; Al: 0 to 3.0%; Cu: 0 to 1%; Co: 0 to 3%; Ga: 0 to 2%; Gd: 0 to 2%; Ho: 0 to 2%; Zr: 0 to 2%; with Fe being the balance.

Moreover, the present invention provides a method for preparing a neodymium iron boron magnet according to the second embodiment, comprising the following steps:

A) smelting and then crushing the mixture of light and heavy rare earths as described above to obtain an alloy powder of mixed rare earths;

B) mixing the alloy powder of mixed rare earths obtained from the above step with an organic solvent to obtain a turbid liquid;

C) coating the turbid liquid obtained from the above step onto the surface of a neodymium iron boron magnet blank to obtain a semi-finished product; and D) subjecting the semi-finished product obtained from the above step to heat treatment to obtain the neodymium iron boron magnet.

Preferably, the particle size of the alloy powder of mixed rare earths is 1 to 20 μm.

Preferably, the organic solvent comprises one or more selected from the group consisting of gasoline, ethanol and acrylic acid.

Preferably, the mixing is conducted at a temperature of 15 to 35° C. for a period of 7 to 17 h.

Preferably, the heat treatment comprises high-temperature diffusion treatment and low-temperature tempering treatment.

Preferably, the high-temperature diffusion treatment is carried out at a temperature of 700 to 1000° C. for a period of 3 to 20 h; and the low-temperature tempering treatment is carried out at a temperature of 350 to 750° C. for a period of 1 to 8 h.

The mixture of light and heavy rare earths used for the neodymium iron boron magnet provided according to the present invention comprises 2 to 20 parts by weight of light rare earth, 78 to 98 parts by weight of heavy rare earth and 0 to 2 parts by weight of M; wherein the M is one or more selected from the group consisting of Al, Cu, Co, Ni, Zr and Nb. Compared with the prior art, the present invention employs light rare earth and heavy rare earth having a specific formulation in combination with other metal elements, resulting in a mixture of light and heavy rare earths represented by RLxRHyMz; when it is applied to neodymium iron boron magnet, the coercive force of the magnet is significantly enhanced, and at the same time, the original magnetic remanence and maximum magnetic energy product of the magnet are not significantly reduced. Moreover, the cost is saved by utilizing light rare earth. The experimental results indicate that, when the mixture of light and heavy rare earths provided according to the present invention is used for neodymium iron boron magnet, the coercive force of the magnet can be enhanced by a maximum of about 39% while the magnetic remanence and maximum magnetic energy product essentially remain constant.

DETAILED EMBODIMENTS

Figure 1:
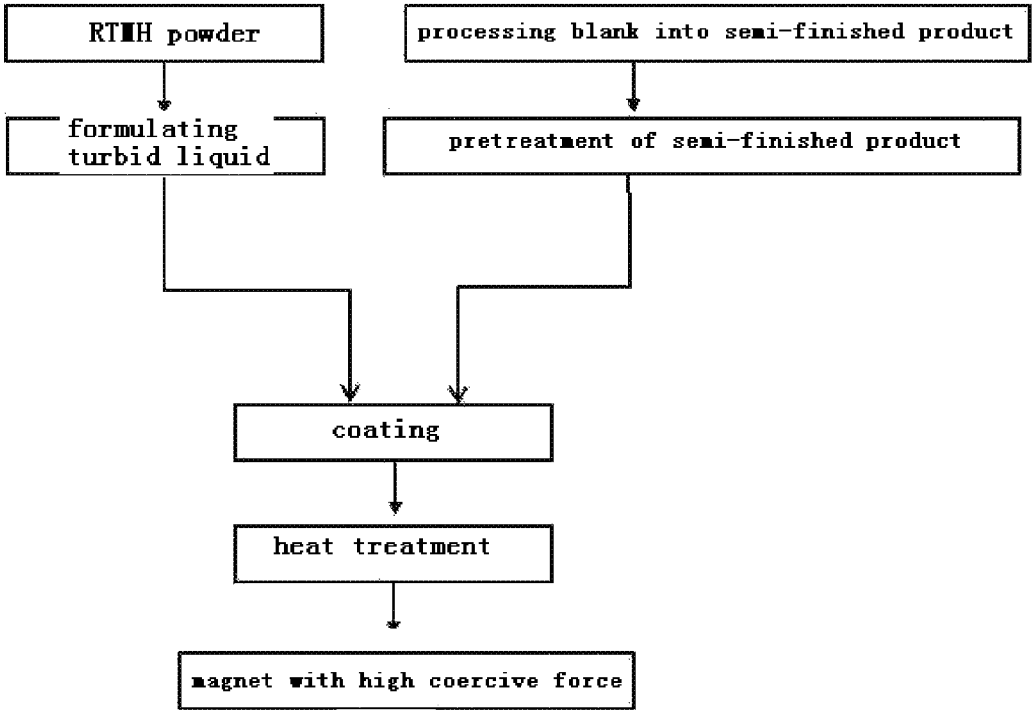
FIG. 1 is a process flow diagram showing the method for preparing the neodymium iron boron magnet provided according to the first embodiment according to the present invention described above.

To further understand the present invention, the preferred embodiments of the present invention are described below in conjunction with examples. It should be understood that, these descriptions are merely intended for further illustrating the features and advantages of the present invention, rather than constituting any limitation to the claims of the present invention.

The neodymium iron boron magnet of the present invention and the method for preparing the same are described in details hereinafter.

The sources of all of the raw materials used in the present invention are not particularly restricted, as long as they can be purchased on the market or prepared according to the conventional methods well known to a person skilled in the art; and there are no particular restrictions on the purity of all of the raw materials used in the present invention, but analytical pure reagents are preferably used in the present invention.

The neodymium iron boron magnet according to the present invention may be roughly divided into two embodiments. The neodymium iron boron magnet of the present invention is hereinafter described while divided into a first embodiment and a second embodiment.

1. First Embodiment (1) A Neodymium Iron Boron Magnet

The first embodiment of the present invention provides a neodymium iron boron magnet comprising a neodymium iron boron magnet blank and an RTMH alloy layer compounded on the surface thereof; wherein the R is one or more selected from rare earth elements;

the T is Fe and/or Co;

the M is one or more selected from the group consisting of Al, Si, Ti, V, Cr, Mn, Ni, Cu, Zn, Ga, Ge, Zr, Nb, Mo, Ag, In, Sn, Sb, Hf, Ta, W, Pt, Au, Pb and Bi; and the H is hydrogen element.

In the RTMH alloy of the present invention, the R is preferably selected from one or more of rare earth elements, and more preferably one or more selected from the group consisting of Sc, Y, La, Ce, Pr, Nd, Pm, Sm, Eu, Gd, Tb, Dy, Ho, Er, Tm, Yb and Lu; the T is preferably Fe and/or Co, and more preferably Fe or Co; the M is preferably one or more selected from the group consisting of Al, Si, Ti, V, Cr, Mn, Ni, Cu, Zn, Ga, Ge, Zr, Nb, Mo, Ag, In, Sn, Sb, Hf, Ta, W, Pt, Au, Pb and Bi, and more preferably more than one selected from the group consisting of Al, Ti, Mn, Cu, Ga, Ge, Zr, Mo, Ag, In, Sn, Ta, W, Au and Bi; and the H is hydrogen element.

In the present invention, there are no special restrictions on the specific proportions of respective ingredients in the RTMH alloy, which can be selected and adjusted by those skilled in the art according to the factors such as actual production situations, product requirements and quality control. In the RTMH alloy layer of the present invention, the R is preferably in 50 to 100 parts by weight, more preferably in 60 to 90 parts by weight, and most preferably in 70 to 80 parts by weight; the T is preferably less than or equal to 44 parts by weight, more preferably in 5 to 40 parts by weight, still more preferably in 10 to 30 parts by weight, and most preferably in 15 to 25 parts by weight; the M is preferably less than or equal to 49 parts by weight, more preferably in 5 to 45 parts by weight, still more preferably in 10 to 40 parts by weight, and most preferably in 15 to 35 parts by weight; the H is preferably less than or equal to 2 parts by weight, more preferably in 0.2 to 1.8 parts by weight, still more preferably in 0.5 to 1.5 parts by weight, and most preferably in 0.8 to 1.2 parts by weight. In the present invention, there are no special restrictions on the source of hydrogen element in the RTMH alloy, as long as the hydrogen element is added into the alloy by the ways well known to those skilled in the art. In the present invention, hydrogen element is preferably introduced by means of subjecting the raw materials to hydrogen absorption reaction during the process of hydrogen decrepitation, and the content of hydrogen element is controlled by the process of hydrogen absorption reaction or the process of the subsequent dehydrogenation reaction. In the present invention, there are no special restrictions on the specific proportions of the RTMH alloy in the neodymium iron boron magnet according to the first embodiment, which can be selected and adjusted by those skilled in the art according to the factors such as actual production situations, product requirements and quality control. In the present invention, the mass proportion of the RTMH alloy layer with respect to the total mass of the neodymium iron boron magnet according to the first embodiment is preferably less than or equal to 5%, more preferably 1% to 4%, more preferably 1.5% to 3.5%, and most preferably 2% to 3%.

In the present invention, there are no special restrictions on the composition of the neodymium iron boron magnet blank, as long as the neodymium iron boron magnet blank has a composition well known to those skilled in the art can be adopted. It can be selected and adjusted according to the factors such as actual production situations, product requirements and quality control. The neodymium iron boron magnet blank of the present invention preferably comprise respective ingredients in the following mass percentages: Pr—Nd: 28% to 33%, Dy: 0 to 10%, Tb: 0 to 10%, Nb: 0 to 5%, B: 0.5% to 2.0%, Al: 0 to 3.0%, Cu: 0 to 1%, Co: 0 to 3%, Ga: 0 to 2%, Gd: 0 to 2%, Ho: 0 to 2%, Zr: 0 to 2%, with Fe being the balance, more preferably comprise Pr—Nd: 28.40% to 33.00%, Dy: 0.50% to 6.0%, Tb: 0.50% to 6.0%, B: 0.92% to 0.98%, Al: 0.10% to 3.0%, Cu: 0.10% to 0.25%, Co: 0.10% to 3.0%, Ga: 0.1% to 0.3%, with Fe being the balance. Based on the composition in mass percentages, the ingredients of the neodymium iron boron magnet blank of the present invention preferably further comprise one or more of other rare earth elements, more preferably further comprise one or more selected from the group consisting of Sc, Y, La, Ce, Pm, Sm, Eu, Er, Tm, Yb and Lu, and most preferably Sc and/or Y. In the present invention, there are no special restrictions on the neodymium iron boron magnet blank, as long as it is neodymium iron boron magnet blank well known to those skilled in the art can be adopted. That is, the neodymium iron boron raw materials are subjected to the steps of formulating, smelting, crushing to produce powder, oriented compact shaping of powder, vacuum sintering, and the like to obtain neodymium iron boron magnet blank, which is further subjected to surface treatment and processing, then it may be used as ordinary finished product of neodymium iron boron magnet.

In the present invention, there are no special restrictions on the compounding, as long as it is a compounding means well known to those skilled in the art. The specific means for compounding in the present invention are preferably one or more of brushing, spreading, spraying, coating, binding, roll forming, immersing and dipping, and coating is preferably in the present invention. In the present invention, there are no special restrictions on the specific process of the compounding, which can be adjusted and selected by those skilled in the art according to the actual use environment, product requirements or requirements for anticorrosion. The compounding in the present invention is preferably compounding after heat treatment. In the present invention, there are no other special restrictions on the heat treatment, as long as it is a diffusion heat treatment process for the neodymium iron boron magnet well known to those skilled in the art.

(2) A Method for Preparing Neodymium Iron Boron Magnet

The present invention further provides a method for preparing the neodymium iron boron magnet according to the first embodiment, comprising the following steps:

A) mixing RTMH alloy powder with an organic solvent to obtain a turbid liquid;

wherein the R is one or more selected from rare earth elements; the T is Fe and/or Co; the M is one or more selected from the group consisting of Al, Si, Ti, V, Cr, Mn, Ni, Cu, Zn, Ga, Ge, Zr, Nb, Mo, Ag, In, Sn, Sb, Hf, Ta, W, Pt, Au, Pb and Bi; and the H is hydrogen element;

B) coating the turbid liquid obtained from the above step onto the surface of a neodymium iron boron magnet blank to obtain a semi-finished product;

C) subjecting the semi-finished product obtained from the above step to heat treatment to obtain the neodymium iron boron magnet according to the first embodiment.

In the above method of the present invention, unless otherwise specified, the selection scope and preferred principle for the raw materials are identical to the selection scope and preferred principle for the neodymium iron boron magnet described above. There is no need to repeat here.

In the present invention, at first, RTMH alloy powder and an organic solvent are mixed to obtain a turbid liquid. In the present invention, there are no special restrictions on the sources of the RTMH alloy powder, which can be prepared by the method for preparing alloy powder well known to those skilled in the art or purchased on the market. It is preferably obtained after subjecting the raw materials in certain proportions to formulating, smelting, hydrogen decrepitation (hydrogen absorption) in the present invention. Selection and adjustment are performed according to actual production situations, product requirements or quality control, and the preferred embodiments are those that enable homogenous mixing and effective coating. The average particle size of the RTMH alloy powder in the present invention is preferably 1 to 20 μm, more preferably 2 to 17 μm, still more preferably 2 to 12 μm, and most preferably 2 to 8 μm.

In the present invention, there are no special restrictions on the organic solvents, which can be adjusted and selected by those skilled in the art according to actual use environment, product requirements or requirements for anticorrosion. The organic solvent in the present invention is preferably a volatile organic solvent; more preferably comprises one or more selected from the group consisting of gasoline, ethanol and acrylic acid; more preferably is gasoline, ethanol or acrylic acid; still more preferably gasoline and/or ethanol; and most preferably gasoline or ethanol. In the present invention, there are no special restrictions on the addition amount of the organic solvent, which can be adjusted by those skilled in the art according to actual production situations. The preferred embodiments are those that enable homogenous dispersion. In the present invention, there are no special restrictions on the mixing conditions, which can be adjusted by those skilled in the art according to actual production situations, product requirements or quality control. The preferred embodiments are those that enable to be homogenously mixed and dispersed into a turbid liquid. The mixing temperature of the present invention is preferably 15 to 35° C., more preferably 20 to 30° C., and most preferably 23 to 27° C.; and the mixing time is preferably 7 to 17 h, more preferably 10 to 15 h, and most preferably 12 to 13 h.

In the present invention, after obtaining the turbid liquid from the above step, the turbid liquid is coated onto the surface of the neodymium iron boron magnet blank to obtain a semi-finished product. In the present invention, the proportions and preferred principle for the neodymium iron boron magnet blank are identical to those of the neodymium iron boron magnet blank described above. There is no need to repeat here.

In the present invention, there are no special restrictions on the neodymium iron boron magnet blank, as long as it is a neodymium iron boron magnet blank well known to those skilled in the art. That is, the neodymium iron boron raw materials are subjected to the steps of formulating, smelting, crushing to produce powder, oriented compact shaping of powder, vacuum sintering, and the like to obtain the neodymium iron boron magnet blank, which is further subjected to surface treatment and processing, then it may be used as ordinary finished product of neodymium iron boron magnet. In the present invention, to more favorably enhance the properties of the neodymium iron boron magnet according to the first embodiment, it is also preferable to process the neodymium iron boron magnet blank into a semi-finished product having a size close to that of the finished product, wherein the size of the semi-finished product in the oriented direction is close to the size of the finished product. More preferably, on the basis of above, the neodymium iron boron magnet blank are further subjected to pretreatments such as oil removal and cleaning to make the surface thereof flat and clean, such that a better coating effect is obtained.

In the present invention, there are no special restrictions on the coating, as long as it is a coating process well known to those skilled in the art. It is preferable to comprise the ways such as spreading, spraying, soaking or dipping, and soaking is preferred in the present invention, i.e. the neodymium iron boron magnet blank is soaked into the turbid liquid to obtain a semi-finished product. In the present invention, there are no special restrictions on the amount of coating, which can be self-adjusted by those skilled in the art according to actual production situations, product requirements and quality requirements. In the present invention, those satisfying homogenous and thorough coating are preferable.

In the present invention, the semi-finished product obtained from the above step is subjected to heat treatment to obtain the neodymium iron boron magnet according to the first embodiment. In the present invention, there are no special restrictions on the process or steps of heat treatment, as long as it is a process similar to the heat treatment well known to those skilled in the art. High-temperature diffusion treatment and low-temperature tempering treatment are preferably included in the present invention. In the present invention, there are no special restrictions on the specific process of the high-temperature diffusion treatment, as long as it is a high-temperature diffusion treatment process well known to those skilled in the art. The embodiments which ensure growth of the crystalline grains of magnets essentially do not occur are regarded as the preferred embodiments in the present invention; on basis of this, more preferably, the high-temperature diffusion treatment is carried out at a temperature of preferably 700 to 1000° C., more preferably 750 to 950° C., and most preferably 800 to 900° C. for a period of preferably 3 to 20 h, more preferably 5 to 18 h, still more preferably 8 to 15 h, and most preferably 10 to 12 h. The low-temperature tempering treatment is carried out at a temperature of preferably 350 to 750° C., more preferably 400 to 700° C., and most preferably 500 to 600° C. for a period of preferably 1 to 8 h, more preferably 2 to 7 h, more preferably 3 to 6 h, and most preferably 4 to 5 h.

In the present invention, there are no special restrictions on the other conditions of the heat treatment, as long as they are conditions for heat treatment of magnets well known to those skilled in the art. To improve the effect of heat treatment process, in the present invention, it is preferable to evacuate the heat treatment environment to be $10^{-2}$ Pa or less, and then heat treatment is carried out under the protective atmosphere. In the present invention, there are no special restrictions on the equipment for heat treatment, as long as it is equipment for heat treatment of magnets well known to those skilled in the art. The present invention preferably adopts vacuum sintering furnace, more preferably adopts sintering box with a flat bottom, and still more preferably adopts graphite box or C—C board that is not easily deformed.

In the present invention, after the above steps, the neodymium iron boron magnet according to the first embodiment is obtained. In the present invention, after the above step, there are no special restrictions on the post-treatment steps which may also be included such as cleaning and slicing, and those skilled in the art can adjust or select them according to actual production situations, product requirements, or the like. With reference to FIG. 1, which is a process flow diagram showing the method for preparing the neodymium iron boron magnet provided by the first embodiment according to the present invention.

The neodymium iron boron magnet according to the first embodiment is obtained by coating RTMH alloy powder onto the surface of the neodymium iron boron magnet blank through above steps and then being subjected to diffusion heat treatment in present invention. In the present invention, at first, RTMH alloy powder is formulated into a turbid liquid, and the turbid liquid is subjected to crystal boundary diffusion and permeation treatment, i.e. the RTMH alloy powder is firstly attached to the outer surface of the magnet as the diffusion source by means of coating, deposition, plating, sputtering, sticking, etc. By performing heat treatment in a certain temperature range, not only RTMH alloy powder is coated onto the surface of the neodymium iron boron magnet blank to form the RTMH alloy layer, but also the RTMH alloy powder at the boundaries is diffused to the grain surface layer in main phase along the crystal boundary to replace Nd in the grain surface layer $Nd_2Fe_{14}B$ and to form (Nd, alloy powder)$_2Fe_{14}B$ shell structure, thereby enhancing the anisotropy field around the crystalline grain surface, while improving the microscopic structure at the crystal boundary. Consequently, the coercive force of the magnet is significantly enhanced, and the original magnetic remanence and maximum magnetic energy product of magnets are not significantly reduced, which avoids the problem that after oxidation of heavy rare earth compounds, not only the effect of enhancing coercive force is not attained, but also the resources of heavy rare earth are wasted; thereby saves the resources of heavy rare earth and reduces the cost. The experimental results indicate that, as for the neodymium iron boron magnet provided according to the first embodiment of the present invention, i.e. a composite type of neodymium iron boron magnet, the coercive force thereof can be enhanced by a maximum of about 51%, while the magnetic remanence and maximum magnetic energy product essentially remain constant and are not significantly reduced.

2. Second Embodiment

(1) A Neodymium Iron Boron Magnet

The second embodiment of the present invention provides a neodymium iron boron magnet, which is obtained after subjecting a neodymium iron boron magnet blank and a mixture of light and heavy rare earths to a diffusing heat treatment.

The mixture of light and heavy rare earths used for the neodymium iron boron magnet provided according to the second embodiment of the present invention comprises, 2 to 20 parts by weight of light rare earth;

78 to 98 parts by weight of heavy rare earth; and 0 to 2 parts by weight of M.

The use amount of the light rare earth in the present invention is preferably 2 to 20 parts by weight, more preferably 3 to 19 parts by weight, still more preferably 4 to 17 parts by weight, and most preferably 5 to 15 parts by weight; the use amount of the heavy rare earth is preferably 78 to 98 parts by weight, more preferably 80 to 95 parts by weight, still more preferably 82 to 93 parts by weight, and most preferably 85 to 90 parts by weight; and the use amount of M is preferably 0 to 2 parts by weight, more preferably 0.3 to 1.8 parts by weight, still more preferably 0.5 to 1.5 parts by weight, and most preferably 0.7 to 1.2 parts by weight. The M is preferably one or more selected from the group consisting of Al, Cu, Co, Ni, Zr and Nb, more preferably one or more selected from the group consisting of Al, Cu, Co, Ni, Zr and Nb, still more preferably one or more selected from the group consisting of Al, Cu, Co, Ni and Nb, and most preferably one or more selected from the group consisting of Al, Cu, Ni and Nb; the light rare earth is preferably one or more selected from the group consisting of La, Ce, Pr and Nd, more preferably one or more selected from the group consisting of La, Ce and Pr, and more preferably La and/or Pr; and the heavy rare earth is preferably one or more selected from the group consisting of Dy and Tb.

In the present invention, the proportions and preferred principle for the mixture of light and heavy rare earths in the neodymium iron boron magnet according to the second embodiment are identical to those of the mixture of light and heavy rare earths mentioned as described above. There is no need to repeat here. In the present invention, there are no special restrictions on the diffusing heat treatment, as long as it is diffusing heat treatment processes for neodymium iron boron magnet well known to those skilled in the art. Selection and adjustment can be performed according to the factors such as actual production situations, product requirements and quality control. In the present invention, it is preferably obtained after subjecting the above mixture of light and heavy rare earths to diffusing heat treatment on the surface of the neodymium iron boron magnet blank. In the present invention, there are no special restrictions on the composition of the neodymium iron boron magnet blank, as long as the neodymium iron boron magnet blank has a composition well known to those skilled in the art. It can be selected and adjusted according to the factors such as actual production situations, product requirements and quality control. The neodymium iron boron magnet blank of the present invention preferably comprise respective ingredients in the following mass percentages: Pr—Nd: 28% to 33%, Dy: 0 to 10%, Tb: 0 to 10%, Nb: 0 to 5%, B: 0.5% to 2.0%, Al: 0 to 3.0%, Cu: 0 to 1%, Co: 0 to 3%, Ga: 0 to 2%, Gd: 0 to 2%, Ho: 0 to 2%, Zr: 0 to 2%, with Fe being the balance; more preferably comprise Pr—Nd: 28.40% to 33.00%, Dy: 0.50% to 6.0%, Tb: 0.50% to 6.0%, B: 0.92% to 0.98%, Al: 0.10% to 3.0%, Cu: 0.10% to 0.25%, Co: 0.10% to 3.0%, Ga: 0.1% to 0.3%, with Fe being the balance.

(2) A Method for Preparing Neodymium Iron Boron Magnet

The present invention also provides a method for preparing the neodymium iron boron magnet according to the second embodiment, comprising the following steps:

A) smelting and then crushing a mixture of light and heavy rare earths to obtain an alloy powder of mixed rare earths;

B) mixing the alloy powder of mixed rare earths obtained from the above step with an organic solvent to obtain a turbid liquid;

C) coating the turbid liquid obtained from the above step onto the surface of a neodymium iron boron magnet blank to obtain a semi-finished product; and D) subjecting the semi-finished product obtained from the above step to heat treatment to obtain the neodymium iron boron magnet according to the second embodiment.

In the present invention, the mixture of light and heavy rare earths are firstly smelted and then crushed to obtain an alloy powder of mixed rare earths. In the present invention, there are no special restrictions on the means of smelting, as long as it is smelting for metal mixture well known to those skilled in the art. Smelting under vacuum is preferred in the present invention. In the present invention, there are no special restrictions on the conditions of smelting, as long as they are conditions for smelting of metal mixture well known to those skilled in the art. In the present invention, it is preferable to smelt the mixture of light and heavy rare earths into a mixed rare earth alloy, i.e. alloying. The smelting is preferably carried out at a temperature of 1200 to 1600° C., more preferably 1300 to 1500° C., and most preferably 1350 to 1450° C. In the present invention, there are no special restrictions on the smelting equipment, as long as they are smelting equipment for metal mixture well known to those skilled in the art. In the present invention, vacuum smelting furnace is preferred. The present invention adopts RLxRHyMz to represent a mixture of light and heavy rare earths or a mixed rare earth alloy, wherein RL represents light rare earth, RH represents heavy rare earth, M represents other metal elements, and x, y and z represent corresponding parts by weight, respectively.

In the present invention, the mixed rare earth alloy obtained from the above step is then subjected to crushing to obtain an alloy powder of mixed rare earths, in which the particle size of the alloy powder of mixed rare earths is preferably 1 to 20 μm, more preferably 2 to 12 μm, still more preferably 3 to 10 μm, and most preferably 3 to 8 μm. In the present invention, there are no special restrictions on the means of crushing, as long as it is crushing used for metal mixture well known to those skilled in the art. The crushing of present invention is preferably performed under protective atmosphere, more preferably performed under the protection of nitrogen gas. In the present invention, there are no special restrictions on the other conditions of crushing, as long as they are conditions for crushing of metal mixture well known to those skilled in the art. In the present invention, there are no special restrictions on the crushing equipment, as long as they are crushing equipment used for metal mixture well known to those skilled in the art. In the present invention, air-flow mill is preferred.

In the present invention, the alloy powder of mixed rare earths is subsequently mixed with an organic solvent to obtain a turbid liquid. The organic solvent preferably comprises one or more selected from the group consisting of gasoline, ethanol and acrylic acid, more preferably comprises one or more selected from the group consisting of gasoline, ethanol and acrylic acid, still more preferably is gasoline and/or ethanol, and most preferably is gasoline or ethanol. In the present invention, there are no special restrictions on the addition amount of the organic solvent, and those skilled in the art can adjust according to actual production situations. The preferred embodiments are those that enable homogenous dispersion. In the present invention, there are no special restrictions on the mixing conditions, which can be adjusted by those skilled in the art according to actual production situations. The preferred embodiments are those that enable homogenous dispersion. In the present invention, there are no special restrictions on the mixing conditions, which can be adjusted by those skilled in the art according to actual production situations, product requirements or quality control. The preferred embodiments are those that enable to be homogenously mixed and dispersed into a turbid liquid. The mixing temperature of the present invention is preferably 15 to 35° C., more preferably 20 to 30° C., and most preferably 23 to 27° C.; and the mixing time is preferably 7 to 17 h, more preferably 10 to 15 h, and most preferably 12 to 13 h.

In the present invention, after obtaining the turbid liquid from the above step, the turbid liquid is coated onto the surface of the neodymium iron boron magnet blank to obtain a semi-finished product. In the present invention, the proportions and preferred principle for the neodymium iron boron magnet blank and mixture of light and heavy rare earths are identical to those of the neodymium iron boron magnet blank mixture of light and heavy rare earths described above. There is no need to repeat here.

In the present invention, there are no special restrictions on the neodymium iron boron magnet blank, as long as it is a neodymium iron boron magnet blank well known to those skilled in the art. That is, the neodymium iron boron raw materials are subjected to the steps of formulating, smelting and crushing to produce powder, oriented compact shaping of powder, vacuum sintering, and the like to obtain the neodymium iron boron magnet blank. In the present invention, to more favorably enhance the properties of the neodymium iron boron magnet according to the second embodiment, it is also preferable to process the neodymium iron boron magnet blank into a semi-finished product having a size close to that of the finished product, wherein the size of the semi-finished product in the oriented direction is close to the size of the finished product. More preferably, on the basis of above, the neodymium iron boron magnet blank are further subjected to pretreatments such as oil removal and cleaning to make the surface thereof flat and clean, such that a better coating effect is obtained.

In the present invention, there are no special restrictions on the coating, as long as it is a coating process well known to those skilled in the art. It is preferable to comprise the ways such as spreading, spraying, soaking or dipping. In the present invention, there are no special restrictions on the amount of coating, which can be self-adjusted by those skilled in the art according to actual production situations, product requirements and quality requirements. In the present invention, those satisfying homogenous and thorough coating are preferable.

In the present invention, the semi-finished product obtained from the above step is subjected to heat treatment to obtain the neodymium iron boron magnet according to the second embodiment. In the present invention, there are no special restrictions on the process or steps of heat treatment, as long as it is a process similar to the heat treatment well known to those skilled in the art. High-temperature diffusion treatment and low-temperature tempering treatment are preferably included in the present invention. In the present invention, there are no special restrictions on the specific process of the high-temperature diffusion treatment, as long as it is a high-temperature diffusion treatment process well known to those skilled in the art. The embodiments which ensure growth of the crystalline grains of magnets essentially do not occur are regarded as the preferred embodiments in the present invention; on basis of this, more preferably, the high-temperature diffusion treatment is carried out at a temperature of preferably 700 to 1000° C., more preferably 750 to 950° C., and most preferably 800 to 900° C. for a period of preferably 3 to 20 h, more preferably 5 to 18 h, still more preferably 8 to 15 h, and most preferably 10 to 12 h. The low-temperature tempering treatment is carried out at a temperature of preferably 350 to 750° C., more preferably 400 to 700° C., and most preferably 500 to 600° C. for a period of preferably 1 to 8 h, more preferably 2 to 7 h, more preferably 3 to 6 h, and most preferably 4 to 5 h.

In the present invention, there are no special restrictions on the other conditions of the heat treatment, as long as they are conditions for heat treatment of magnets well known to those skilled in the art. To improve the effect of heat treatment process, in the present invention, it is preferable to evacuate the heat treatment environment to be $10^{-2}$ Pa or less, and then heat treatment is carried out under the protective atmosphere. In the present invention, there are no special restrictions on the equipment for heat treatment, as long as it is equipment for heat treatment of magnets well known to those skilled in the art. The present invention preferably adopts vacuum sintering furnace, more preferably adopts sintering box with a flat bottom, and still more preferably adopts graphite box or C—C board that is not easily deformed.

Figure 2:
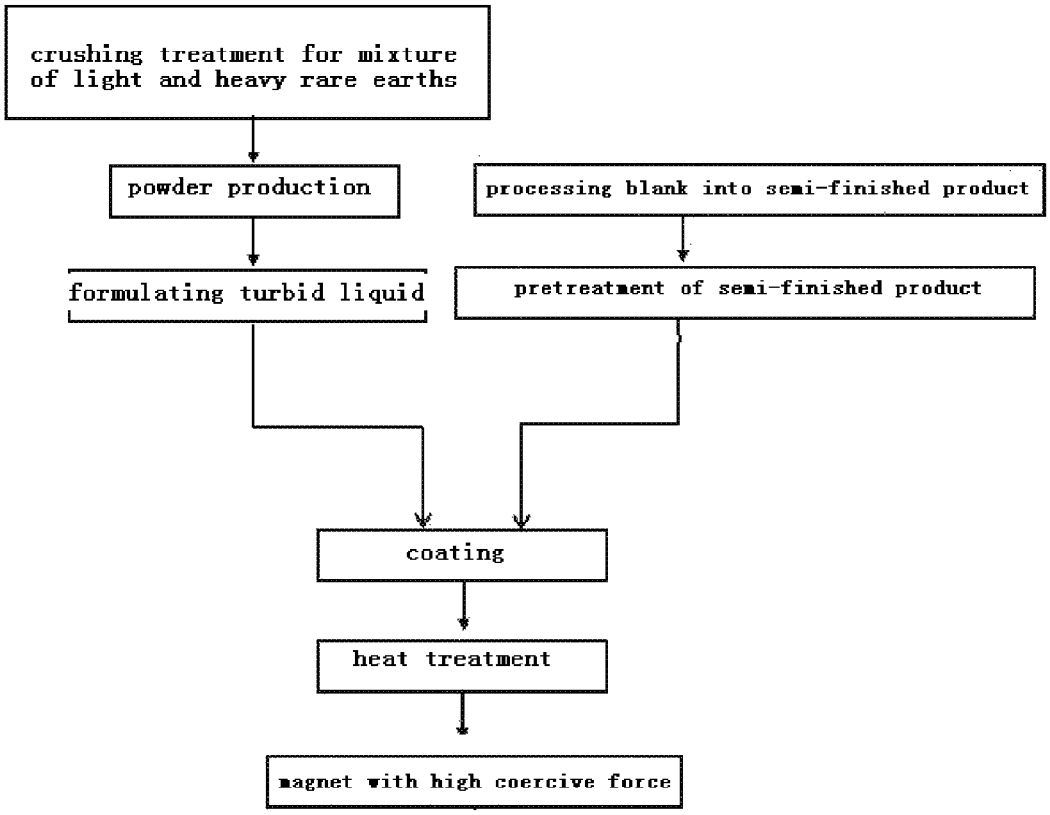
FIG. 2 is a process flow diagram showing the method for preparing the neodymium iron boron magnet provided according to the second embodiment according to the present invention described above.

In the present invention, after the above steps, the neodymium iron boron magnet according to the second embodiment is obtained. In the present invention, after the above step, there are no special restrictions on the post-treatment steps such as cleaning and slicing which may also be included, and those skilled in the art can adjust or select them according to actual production situations, product requirements, or the like. With reference to FIG. 2, which is a process flow diagram showing the method for preparing the neodymium iron boron magnet provided by the second embodiment according to the present invention.

The neodymium iron boron magnet according to the second embodiment is obtained by subjecting alloy of the mixture of light and heavy rare earths to diffusing heat treatment on the surface of neodymium iron boron magnet blank in present invention. The present invention adopts a specific formulation of light rare earth and heavy rare earth in combination with other metal elements to obtain a mixed rare earth alloy RLxRHyMz, which is further formulated into a turbid liquid, and the turbid liquid is subjected to crystal boundary diffusion and permeation treatment, i.e. the alloy powder of mixed rare earths is firstly attached to the outer surface of the magnet as the diffusion source by means of coating, deposition, plating, sputtering, sticking, etc. By performing heat treatment in a certain temperature range, the rare earth elements are diffused to the grain surface layer in main phase along the crystal boundary to replace Nd in the grain surface layer $Nd_2Fe_{14}B$ and to form (Nd, mixed rare earth alloy)$_2Fe_{14}B$ shell structure, thereby enhancing the anisotropy field around the crystalline grain surface, while improving the microscopic structure at the crystal boundary. Consequently, the coercive force of the magnet is significantly enhanced, and the original magnetic remanence and maximum magnetic energy product of magnets are not significantly reduced.

The experimental results indicate that, as for the neodymium iron boron magnet provided according to the first embodiment of the present invention, i.e. a composite type of neodymium iron boron magnet, the coercive force thereof can be enhanced by a maximum of about 51%, while the magnetic remanence and maximum magnetic energy product essentially remain constant and are not significantly reduced. Moreover, the cost is reduced due to use of light rare earth. The experimental results indicate that, when the mixture of light and heavy rare earths provided according to the present invention is used for the neodymium iron boron magnet according to the second embodiment, the coercive force of the magnet can be enhanced by a maximum of about 39%, while the magnetic remanence and maximum magnetic energy product essentially remain constant.

To further understand the present invention, the neodymium iron boron magnets provided according to the present invention and the method for preparing the same are illustrated below in conjunction with Examples. The protection scope of the present invention is not limited by the examples that follow.

EXAMPLE 1

This Example is used for illustrating the neodymium iron boron magnet according to the first embodiment of the present invention and the preparation method thereof.

RTMH alloy powder was formulated according to the following formulation:

R was selected from Nd, T was selected from Fe, M was selected from Al; the mass percentages of Nd, Fe, Al, H in the powder were 70%, 15%, 14.5% and 0.5%, respectively; and the average particle size of the powder was about 3.0 μm.

The RTMH alloy powder obtained from the above step, i.e. NdFeAlH fine powder, was added to ethanol to form a turbid liquid.

Blank of 35UH magnet prepared by smelting, milling, shaping and sintering steps was processed into a semi-finished product of 59×11×1.8 mm (1.8 mm was the size in the oriented direction). The semi-finished product was subjected to pretreatments such as processing and oil removal to create clean and flat surface; then the pretreated semi-finished product was placed into the turbid liquid for soaking and coating, such that the surface thereof was uniformly coated with a layer of NdFeAlH film, wherein the mass of the coating was 3% with respect to the total mass thereof; then the semi-finished product was placed into a sintering graphite box, and the graphite box charged with the product was placed into a sintering furnace, which was evacuated to be $10^{-2}$ Pa or low. In argon, a first heat treatment was performed for 10 h at a temperature of 880° C., then the second heat treatment of low temperature tempering was performed for 5 h at a temperature of 510° C. to obtain the neodymium iron boron magnet.

Comparison by parallel experiment was performed on the neodymium iron boron magnet prepared by the above method of the present invention and conventional neodymium iron boron magnet, and the comparison results are shown in Table 1. Table 1 gives the performance data of magnets before and after implementation.

TABLE 1

The performance data of magnets before and after implementation

| Samples | Br (kGs) | Hcj (kOe) | (BH)max (MGOe) |
|---|---|---|---|
| 35UH | 12.37 | 20.13 | 36.74 |
| 35UH-Nd70Fe15Al4.5H0.5 | 11.94 | 26.17 | 35.09 |

From Table 1, it is clear that the neodymium iron boron magnet prepared by the above method of the present invention is about 30% higher than that of conventional neodymium iron boron magnet in terms of coercive force performance of magnets, while the magnetic remanence and maximum magnetic energy product performance essentially remain constant.

EXAMPLE 2

This Example is used for illustrating the neodymium iron boron magnet according to the first embodiment of the present invention and the preparation method thereof.

RTMH alloy powder was formulated according to the following formulation:

R was selected from Tb, T was selected from Co, M was selected from Cu; the mass percentages of Tb, Co, Cu, H in the powder were 90%, 5.7%, 4% and 0.3%, respectively; and the average particle size of the powder was about 3.6 μm.

The RTMH alloy powder obtained from the above step, i.e. TbCoCuH fine powder, was added to ethanol to form a turbid liquid.

Blank of 48SH magnet prepared by smelting, milling, shaping and sintering steps was processed into a semi-finished product of 44.3×21×1.7 mm (1.7 mm was the size in the oriented direction). The semi-finished product was subjected to pretreatments such as processing and oil removal to create clean and flat surface; then the pretreated semi-finished product was placed into the turbid liquid for soaking and coating, such that the surface thereof was uniformly coated with a layer of TbCoCuH film, wherein the mass of the coating was 2% with respect to the total mass thereof; then the semi-finished product was placed into a sintering graphite box, and the graphite box charged with the product was placed into a sintering furnace, which was evacuated to be $10^{-2}$ Pa or low. In argon, a first heat treatment was performed for 9 h at a temperature of 850° C., then a second heat treatment of low temperature tempering was performed for 5 h at a temperature of 500° C. to obtain the neodymium iron boron magnet.

Comparison by parallel experiment was performed on neodymium iron boron magnet prepared by the above method of the present invention and conventional neodymium iron boron magnet, and the comparison results are shown in Table 2. Table 2 gives the performance data of magnets before and after implementation.

TABLE 2

The performance data of magnets before and after implementation

| Samples | Br (kGs) | Hcj (kOe) | (BH)max (MGOe) |
|---|---|---|---|
| 48SH | 14.04 | 18.00 | 47.18 |
| 48SH-Tb90Co5.7Cu4H0.3 | 13.81 | 27.10 | 46.14 |

From Table 2, it is clear that the neodymium iron boron magnet prepared by the above method of the present invention is about 51% higher than conventional neodymium iron boron magnet in terms of coercive force performance of magnets, while the magnetic remanence and maximum magnetic energy product performance essentially remain constant.

EXAMPLE 3

This Example is used for illustrating the neodymium iron boron magnet according to the first embodiment of the present invention and the preparation method thereof.

RTMH alloy powder was formulated according to the following formulation:

R was selected from Dy, T was selected from Fe, M was selected from Cu; the mass percentages of Dy, Fe, Cu, H in the powder were 60%, 20%, 19% and 1%, respectively; and the average particle size of the powder was about 3.2 μm.

The RTMH alloy powder obtained from the above step, i.e. DyFeCuH fine powder, was added to ethanol to form a turbid liquid.

Blank of 45M magnets prepared by smelting, milling, shaping and sintering steps was processed into a semi-finished product of 39.5×15.8×2 mm (2 mm was the size in the oriented direction). The semi-finished product was subjected to pretreatments such as processing and oil removal to create clean and flat surface; then the pretreated semi-finished product was placed into the turbid liquid for soaking and coating, such that the surface thereof was uniformly coated with a layer of DyFeCuH film, wherein the mass of the coating was 5% with respect to the total mass thereof; then the semi-finished product was placed into a sintering graphite box, and the graphite box charged with the product was placed into a sintering furnace, which was evacuated to be $10^{-2}$ Pa or low. In argon, a first heat treatment was performed for 10 h at a temperature of 820° C., then a second heat treatment of low temperature tempering was performed for 4 h at a temperature of 510° C. to obtain the neodymium iron boron magnets.

Comparison by parallel experiment was performed on the neodymium iron boron magnet prepared by the above method of the present invention and conventional neodymium iron boron magnet, and the comparison results are shown in Table 3. Table 3 gives the performance data of magnets before and after implementation.

TABLE 3

The performance data of magnets before and after implementation

| Samples | Br (kGs) | Hcj (kOe) | (BH)max (MGOe) |
|---|---|---|---|
| 45M | 13.60 | 17.62 | 44.62 |
| 45M-Dy60Fe20Cu19H | 13.00 | 25.35 | 41.72 |

From Table 3, it is clear that the neodymium iron boron magnet prepared by the above method of the present invention is about 44% higher than conventional neodymium iron boron magnet in terms of coercive force performance of magnets, while the magnetic remanence and maximum magnetic energy product performance essentially remain constant.

EXAMPLE 4

This Example is used for illustrating the neodymium iron boron magnet according to the second embodiment of the present invention and the preparation method thereof.

The mixture of light and heavy rare earths RLxRHyMz, in which RL was selected from Nd, RH was selected from Dy, and M was selected from Al, was obtained by mixing RL, RH and M in a weight ratio of x, y and z to be 20:78:2.

The rare earth mixture obtained from the above step was subjected to dehydrogenation treatment at 500° C. to obtain an alloy of rare earth mixture. Next, the alloy of rare earth mixture was crushed into powder with an average particle size of about 2.4 μm by air-flow mill under the protection of nitrogen gas. The crushed fine powder was added to ethanol to form a turbid liquid.

The neodymium iron boron magnet blank of 42SH was processed into a semi-finished product of 40×21×1.9 mm (1.9 mm was the size in the oriented direction. The semi-finished product was subjected to pretreatments such as processing and oil removal to create clean and flat surface; then the pretreated semi-finished product was placed into the turbid liquid for soaking and coating, such that the surface thereof was uniformly coated with a film layer of the mixture of light and heavy rare earths, which was air dried; then the semi-finished product was placed into a sintering graphite box, and the graphite box charged with the product was placed into a sintering furnace, which was evacuated to be $10^{-2}$ Pa or low. In argon, high-temperature diffusing heat treatment was performed for 8 h at a temperature of 860° C., then low-temperature tempering heat treatment was performed for 5 h at a temperature of 510° C. to obtain the neodymium iron boron magnets.

Comparison by parallel experiment was performed on neodymium iron boron magnet prepared by the above method of the present invention and conventional neodymium iron boron magnet, and the comparison results are shown in Table 4. Table 4 gives the performance data of magnets before and after implementation.

TABLE 4

The performance data of magnets before and after implementation

| Samples | Br (kGs) | Hcj (kOe) | (BH)max (MGOe) |
|---|---|---|---|
| 42SH | 13.29 | 19.45 | 42.55 |
| 42SH-$Nd_{20}Dy_{78}Al_2$ | 13.13 | 27.01 | 41.41 |

From Table 4, it is clear that the neodymium iron boron magnet prepared by the above method of the present invention is about 39% higher than conventional neodymium iron boron magnet in terms of coercive force performance of magnets, while the magnetic remanence and maximum magnetic energy product performance essentially remain constant.

EXAMPLE 5

This Example is used for illustrating the neodymium iron boron magnet according to the second embodiment of the present invention and the preparation method thereof.

The mixture of light and heavy rare earths RLxRHyMz, in which RL was selected from Pr and RH was selected from Tb, was obtained by mixing RL, RH and M in a weight ratio of x, y and z to be 10:90:0.

The rare earth mixture obtained from the above step was subjected to dehydrogenation treatment at 480° C. to obtain an alloy of rare earth mixture. Then the alloy of rare earth mixture was crushed into powder with an average particle size about 2.4 μm by jet milling under the protection of nitrogen gas. The crushed fine powder was added to ethanol to form a turbid liquid.

The neodymium iron boron magnet blank of 45 SH was processed into a semi-finished product of 22.83×13×4.9 mm (4.9 mm was the size in the oriented direction). The semi-finished product was subjected to pretreatments such as processing and oil removal to create clean and flat surface; then the pretreated semi-finished product was placed into the turbid liquid for soaking and coating, such that the surface thereof was uniformly coated with a film layer of the mixture of light and heavy rare earths, which was air dried; then the semi-finished product was placed into a sintering graphite box, and the graphite box charged with the product was placed into a sintering furnace, which was evacuated to be $10^{-2}$ Pa or low. In argon, high-temperature diffusing heat treatment was performed for 9 h at a temperature of 800° C., then low-temperature tempering heat treatment was performed for 5 h at a temperature of 510° C. to obtain the neodymium iron boron magnets.

Comparison by parallel experiment was performed on the neodymium iron boron magnet prepared by the above method of the present invention and conventional neodymium iron boron magnet, and the comparison results are shown in Table 5. Table 5 gives the performance data of magnets before and after implementation.

TABLE 5

The performance data of magnets before and after implementation

| Samples | Br (kGs) | Hcj (kOe) | (BH)max (MGOe) |
|---|---|---|---|
| 45SH | 13.4 | 20.9 | 42.84 |
| 45SH-$Pr_{10}Tb_{90}$ | 13.32 | 26.51 | 42.5 |

EXAMPLE 6

This Example is used for illustrating the neodymium iron boron magnet according to the second embodiment of the present invention and the preparation method.

The mixture of light and heavy rare earths RLxRHyMz, in which RL was selected from Nd, RH was selected from Tb, and M was selected from Cu, was obtained by mixing RL, RH and M in a weight ratio of x, y and z to be 5:94:1.

The rare earth mixture obtained from the above step was subjected to dehydrogenation treatment at 480° C. to obtain an alloy of rare earth mixture. Next, the alloy of rare earth mixture was crushed into powder with an average particle size about 2.4 μm by jet milling under the protection of nitrogen gas. The crushed fine powder was added to gasoline to form a turbid liquid.

The neodymium iron boron magnet blank of 38 SH was processed into a semi-finished product of 40×21×1.9 mm (1.9 mm was the size in oriented direction). The semi-finished product was subjected to pretreatments such as processing and oil removal to create clean and flat surface; then the pretreated semi-finished product was placed into the turbid liquid for soaking and coating, such that the surface thereof was uniformly coated with a film layer of the mixture of light and heavy rare earths, which was air dried; then the semi-finished product was placed into a sintering graphite box, and the graphite box charged with the product was placed into a sintering furnace, which was evacuated to be $10^{-2}$ Pa or low. In argon, high-temperature diffusing heat treatment was performed for 9 h at a temperature of 800° C., then low-temperature tempering heat treatment was performed for 5 h at a temperature of 510° C. to obtain the neodymium iron boron magnet.

Comparison by parallel experiment was performed on the neodymium iron boron magnet prepared by the above method of the present invention and conventional neodymium iron boron magnet, and the comparison results are shown in Table 6. Table 6 gives the performance data of magnets before and after implementation.

TABLE 6

The performance data of magnets before and after implementation

| Samples | Br (kGs) | Hcj (kOe) | (BH)max (MGOe) |
|---|---|---|---|
| 38SH | 12.51 | 19.53 | 35.86 |
| 38SH-$Nd_5Dy_{94}Cu_1$ | 12.48 | 25.36 | 36.66 |

The neodymium iron boron magnets provided according to the present invention and the preparation methods have been described above in details. In the present application, specific examples are provided to illustrate the principle and embodiments of the present invention, but the illustration regarding the above examples is only used for helping to understand of the methods of the present invention and core concepts thereof. It should be noted that, several improvements and modifications to the present invention may be made by those skilled in the art without departing from the principle of the present invention, and these improvements and modifications also fall within the protection scope of the claims of the present invention.

The invention claimed is:

1. A neodymium iron boron magnet, comprising a neodymium iron boron magnet blank and an RTMH alloy layer compounded on the surface, wherein the R is one or more selected from rare earth elements Nd, Tb and Dy;

the T is Fe and/or Co;

the M is one or more elements selected from the group consisting of Al, Si, Ti, V, Cr, Mn, Ni, Cu, Zn, Ga, Ge, Zr, Nb, Mo, Ag, In, Sn, Sb, Hf, Ta, W, Pt, Au, Pb and Bi; and the H is hydrogen element;

the RTMH alloy layer comprises:

70 to 80 parts by weight of R;

15 to 25 parts by weight of T;

15 to 35 parts by weight of M; and 0.8 to 1.2 parts by weight of H;

the mass proportion of the RTMH alloy layer with respect to the total mass of the neodymium iron boron magnet is 2% to 3%.

2. The neodymium iron boron magnet according to claim 1, wherein the neodymium iron boron magnet blank comprises respective ingredients in the following mass percentages: Pr—Nd: 28% to 33%; Dy: 0 to 10%; Tb: 0 to 10%; Nb: 0 to 5%; B: 0.5% to 2.0%; Al: 0 to 3.0%; Cu: 0 to 1%; Co: 0 to 3%; Ga: 0 to 2%; Gd: 0 to 2%; Ho: 0 to 2%; Zr: 0 to 2%; with Fe being the balance.

3. A method for preparing a neodymium iron boron magnet according to claim 1, comprising:

A) mixing RTMH alloy powder with an organic solvent to obtain a turbid liquid;

wherein the R is one or more selected from rare earth elements; the T is Fe and/or Co; the M is one or more selected from the group consisting of Al, Si, Ti, V, Cr, Mn, Ni, Cu, Zn, Ga, Ge, Zr, Nb, Mo, Ag, In, Sn, Sb, Hf, Ta, W, Pt, Au, Pb and Bi; and the H is hydrogen element;

B) coating the turbid liquid obtained from the above step onto the surface of the neodymium iron boron magnet blank to obtain a semi-finished product; and C) subjecting the semi-finished product obtained from the above step to heat treatment to obtain the neodymium iron boron magnet.

4. The method according to claim 3, wherein the RTMH alloy powder has an average particle size of 1 to 20 μm; and the organic solvent comprises one or more selected from the group consisting of gasoline, ethanol and acrylic acid.

5. The method according to claim 3, wherein the mixing is carried out at a temperature of 15 to 35° C. for a period of 7 to 17 h.

6. The method according to claim 3, wherein the heat treatment comprises high-temperature diffusion treatment and low-temperature tempering treatment.

7. The method according to claim 3, wherein the high-temperature diffusion treatment is carried out at a temperature of 700 to 1000° C. for a period of 3 to 20 h; and the low-temperature tempering treatment is carried out at a temperature of 350 to 750° C. for a period of 1 to 8 h.

* * * * *